US006896052B2

(12) United States Patent
Simpson et al.

(10) Patent No.: US 6,896,052 B2
(45) Date of Patent: May 24, 2005

(54) EXPANDING TUBING

(75) Inventors: Neil Andrew Abercrombie Simpson, Aberdeen (GB); Alexander Craig Mackay, Aberdeen (GB); David Graham Hosie, Sugar Land, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 10/146,357

(22) Filed: May 15, 2002

(65) Prior Publication Data

US 2002/0189696 A1 Dec. 19, 2002

(30) Foreign Application Priority Data

May 15, 2001 (GB) ..... 0111779

(51) Int. Cl.[7] ..... E21B 23/01

(52) U.S. Cl. ..... 166/207; 166/123; 166/230; 166/381

(58) Field of Search ..... 166/118, 123, 166/157, 158, 181, 182, 206, 207, 230, 381, 382, 387

(56) References Cited

U.S. PATENT DOCUMENTS

| | | | | | |
|---|---|---|---|---|---|
| 4,590,655 | A | * | 5/1986 | Javorik | 29/421.1 |
| 4,753,444 | A | * | 6/1988 | Jackson et al. | 277/342 |
| 5,366,012 | A | | 11/1994 | Lohbeck | 166/277 |
| 6,065,500 | A | | 5/2000 | Metcalfe | 138/118 |
| 6,102,120 | A | | 8/2000 | Chen et al. | 166/287 |
| 6,648,071 | B2 | * | 11/2003 | Hackworth et al. | 166/207 |

FOREIGN PATENT DOCUMENTS

| | | | | |
|---|---|---|---|---|
| EP | 0 881 354 A2 | | 2/1998 | E21B/43/10 |
| GB | 2 346 400 | | 8/2000 | E21B/43/10 |
| GB | 2 347 446 | | 9/2000 | E21B/43/10 |
| JP | 63080930 A | * | 4/1988 | B21D/39/04 |
| WO | WO 98/32412 | | 7/1998 | A61J/2/06 |
| WO | WO 99/02818 | | 1/1999 | E21B/43/10 |
| WO | WO 99/23354 | | 5/1999 | E21B/43/10 |
| WO | WO 00/46479 | | 8/2000 | E21B/17/00 |

OTHER PUBLICATIONS

International PCT Search Report, International Application No. PCT/GB 02/02249, dated Sep. 20, 2002.

* cited by examiner

*Primary Examiner*—Zakiya Walker
(74) *Attorney, Agent, or Firm*—Moser, Patterson & Sheridan, L.L.P.

(57) ABSTRACT

A method of expanding tubing downhole comprises providing a section of expandable tubing of a first diameter, and axially compressing the tubing to induce buckling, such that the buckled portion describes a larger second diameter. The resulting diametric expansion may be utilised to anchor or seal the tubing within a larger bore.

87 Claims, 7 Drawing Sheets

EXPANDING TUBING

FIELD OF THE INVENTION

This invention relates to a method of expanding tubing, and in particular to the expansion of tubing downhole. Embodiments of the invention relate to methods of obtaining relatively high expansion ratios. Further embodiments of the invention relate to packers and anchors which utilise expandable tubing.

BACKGROUND OF THE INVENTION

In recent years, the oil and gas exploration and production industry has made increasing use of expandable tubing for use as bore-lining casing and liner, in straddles, and as a support for expandable sand screens. Various forms of expansion tools have been utilised, earlier proposals including expansion dies, cones and mandrels which are pushed or pulled through tubing by mechanical or hydraulic forces. More recently, rotary expansion tools have been employed, these tools featuring rolling elements for rolling contact with the tubing to be expanded while the tool is rotated and advanced through the tubing.

Each of the these expansion apparatus offers different advantages, however there is a limit to the degree of expansion that is achievable using such expansion tools.

It is among the objectives of embodiments of the present invention to provide a method of expanding tubing downhole which permits a relatively large degree of expansion to be achieved.

SUMMARY OF THE INVENTION

According to the present invention there is provided a method of expanding tubing, the method comprising the steps of:

providing a section of expandable tubing of a first diameter; and axially compressing at least a portion of the tubing to induce buckling at said portion, such that said buckled portion describes a larger second diameter.

The axial compression may be induced by application of a substantially axial force, or may be induced at least in part by torsion.

The invention also relates to apparatus for expanding tubing in this manner.

The invention has particular application for use downhole, that is in drilled bores extending through earth formations, but may also be utilised in subsea or surface applications, and of course may be utilised in applications other than those related to the oil and gas industry.

By utilising the buckling of the tubing to achieve expansion, the method obviates the requirement to provide an expansion tool capable of mechanically deforming the tubing to assume the larger diameter, which has conventionally required the provision of an expansion tool it self capable of assuming an external diameter which is at least close to the larger second diameter.

The method of the invention has also been found to facilitate the attainment of relatively high expansion ratios, for example the method may be utilised to achieve expansion ratios in the region of 1.5 to 2, that is the second diameter is 1.5 to 2 times the first diameter, and indeed expansion ratios in excess of 2 are readily achievable. This greatly increases the potential applications for expandable tubing. For example, using the invention it becomes possible to achieve the degree of expansion necessary to allow expandable tubing, or a tool or device including expandable tubing, to be run through production tubing and then expanded into engagement with significantly larger diameter liner.

The tubing may take any appropriate form, and may have a solid wall at said portion, however if it is desired to achieve elevated degrees of expansion, it has been found that this is more readily achievable using slotted or apertured tubing. Most preferably, the slots are substantially axial and the ends of circumferentially adjacent slots overlap, in a similar manner to the expandable tubing produced by the applicant under the EST trade mark. In such tubing an increase in diameter is achieved primarily by deformation or bending of the webs of metal between the overlapping slot ends as the slots open. If desired, the slotted tubing may be provided in combination with an expandable sleeve which maintains the wall of the tubing fluid-tight, in one or both of the unexpanded and expanded conditions; by mounting the tubing on an appropriate mandrel it is thus possible to utilise the present invention to provide a packer. It has been widely recognised by those of skill in the art that slotted tubing contracts axially when expanded, however this has previously been viewed as a disadvantage, and it has not been recognised that this feature of the tubing may be utilised positively to facilitate expansion.

Where an elastomeric or otherwise flexible fluid-tight sleeve is provided in combination with slotted or otherwise apertured tubing, it is preferred that the sleeve is provided in combination with a support; in the absence of such support, the unsupported portions of sleeve extending across open slots or apertures may fail when subject to a differential pressure. Such support may take any appropriate form, including overlapping circumferentially extending members, which may be in the form of "leaves", arranged in an iris-like manner; the degree of overlap may reduce as the tubing is expanded, but preferably a degree of overlap remains in the expanded configuration. Alternatively, the support may take the form of structural fibres of aramid material, such as Kevlar (Trade Mark). The fibres may be provided individually, or more preferably as a weave or mesh which is capable of expanding with the tubing. Typically, the support will be provided between the tubing and the sleeve.

Of course, if the tubing initially features apertures, for example diamond-shaped apertures, axial compression of the tubing will tend to close the apertures, obviating the requirement to provide such a support arrangement.

When provided in combination with a mandrel, the tubing may be mounted in the mandrel to permit a degree of axial relative movement, to allow expansion of the tubing. Preferably, means is provided between the mandrel and the tubing for retaining said relative axial movement therebetween. Such means may take any appropriate form, for example a one-way ratchet ring. Alternatively, spaced portions of the tubing may be fixed to the mandrel and the mandrel may be telescopic or otherwise retractable to permit expansion of the tubing. A ratchet or other one-way movement retaining means may be provided in combination with such a mandrel. The mandrel may also be adapted to be extendable following retraction, to retract the extended tubing.

Preferably, a seal is provided between the mandrel and the tubing, to prevent passage of fluid between the tubing and the mandrel.

Preferably, the degree of expansion is selected to provide engagement with a surrounding structure, which may be a bore wall or existing tubing. In another embodiment, in a multilateral well, the surrounding structure may be an aperture in the wall of a parent wellbore, at the junction between the parent wellbore and a lateral wellbore; the tubing may be expanded to engage and form a snug fit with an opening in the parent wellbore casing. As the opening in the well will not be circular, and the tubing extends through the opening at an angle, it would be difficult if not impossible to achieve such a snug fit using conventional expansion techniques. Most preferably, the degree of expansion is selected to anchor or seal the tubing to the surrounding structure. To assist in anchoring the tubing, the outer surface of the tubing may carry or incorporate a gripping material or structure, such as sharp grains of relatively hard material held in a softer matrix. In one embodiment, a section of tubing may be provided with a gripping structure or arrangement, to provide an anchor, while another section of tubing is provided with a fluid-tight sleeve, to form a packer, straddle or the like.

The tubing may be pre-expanded or pre-formed before application of the compressive force thereto, the pre-expansion serving to ensure that the buckling of the tubing is initiated in the desired manner, and at a predetermined location. The pre-expansion or pre-formation may be carried out on surface, or downhole.

Alternatively, or in addition, the tubing wall may be formed or shaped in a manner to induce buckling in the desired manner. For example, a section of the wall may be relatively thin to create a recess in a wall surface, or indeed the wall may be thinned at a plurality of axially spaced locations to induce a couple in the wall on the wall experiencing axial compression.

Where the tubing is mounted on a close-fitting mandrel, it is of course not possible for the tubing to buckle to assume a smaller diameter configuration.

The portion of the tubing which is expanded may be of limited length, or may be of an extended length, although the buckling of the tubing generally becomes more difficult to control as the length of the portion to be buckled increases.

The compressive force may be applied to tubing by any convenient method, including simply applying weight to the tubing. Alternatively, a compression tool may be provided within the tubing and have portions engaging the tubing to either end of the portion to be compressed, which portions are brought together to expand the tubing; for simplicity, one portion is likely to be fixed and the other portion movable. This method offers the advantage that the tubing need not be anchored or otherwise fixed in the bore for the expansion process to be initiated. The compression tool may be actuated by any suitable means, and may be fluid pressure actuated or may be actuated by an electric motor rotating a screw which draws the engaging portions together. The tool and tubing may thus be mounted on a support which need not be capable of transmitting a substantive axial compression force, such as coil tubing.

BRIEF DESCRIPTION OF THE DRAWINGS

These and other aspects of the invention will now be described, by way of example, with reference to the accompanying drawings, in which.

DETAILED DESCRIPTION OF THE DRAWINGS

Figure 1:
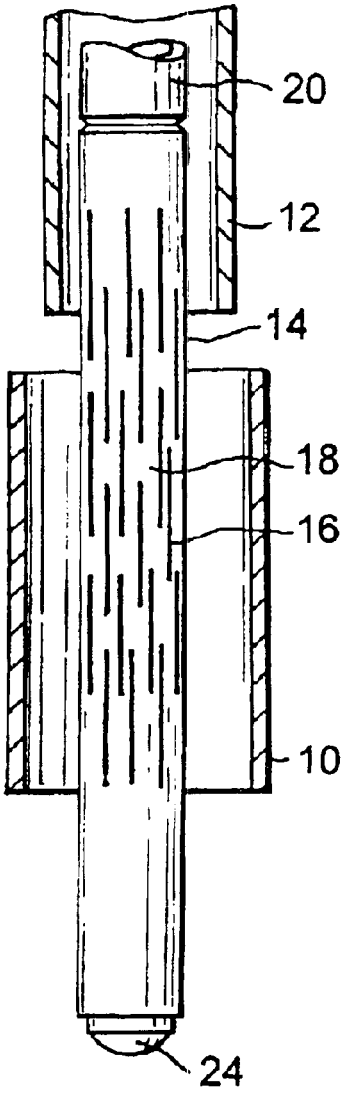
FIGS. 1, 2 and 3 are part-sectional schematic view of stages in an expansion method in accordance with an embodiment of the present invention.
Figure 2:
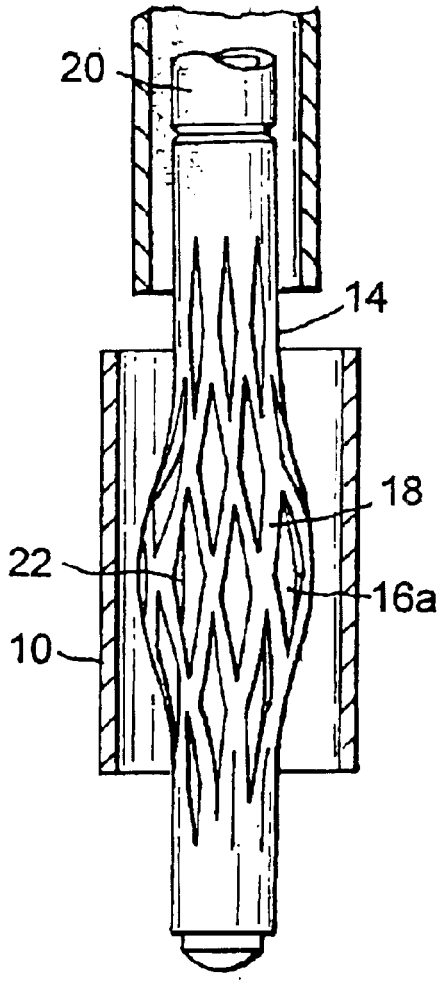
Figure 3:
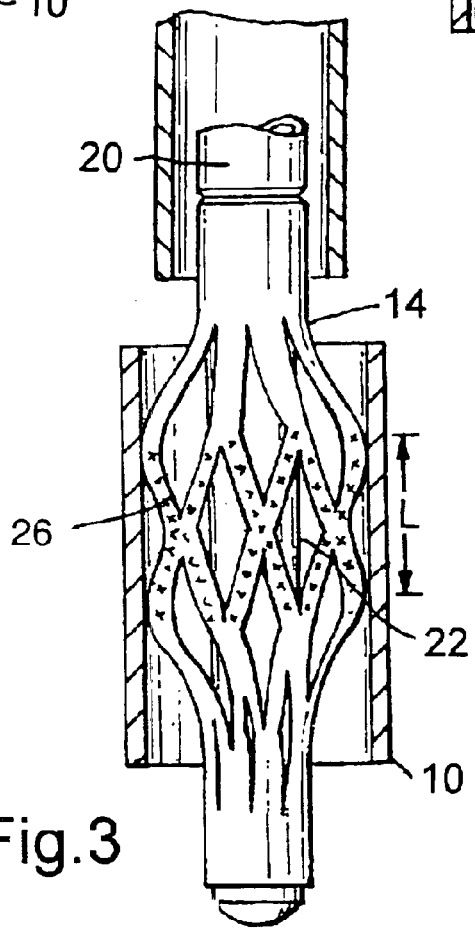

Reference is first made to FIGS. 1, 2 and 3 of the drawings, which illustrate the process of expanding a section of tubing downhole to create an anchor. The Figures show a number of elements of a lined oil or gas production bore (those of skill in the art will recognise that many other elements have been omitted, in the interest of clarity). In particular, the Figures show a 7" liner 10 (internal diameter (i.d.) 6.2") and the lower end of a string of production tubing 12 (i.d. 3.75"). A section of slotted tubing 14 (outer diameter (o.d.) 2.875") has been run into the bore through the production tubing 12 and positioned within the liner 10. The wall of the tubing 14 includes a plurality of rows of axial slots 16, the ends of the slots 16 in adjacent rows overlapping such that there are relatively thin webs of material 18 between the slot ends.

The slotted tubing 14 is mounted to the end of a running string 20, and a telescopic running tool 22 extends through the tubing 14, the end of the tool 22 featuring a shoe 24 which engages and extends from the end of the tubing 14.

In use, the tubing 14 is run into the bore to the location as illustrated in FIG. 1, in which the shoe 24 engages the end of the bore. If weight is then applied to the running string 20, this weight is also applied to and tends to compress the slotted tubing 14. In response to this compression, the wall of the tubing 14 buckles, as illustrated in FIG. 2, this buckling being accommodated primarily by bending of the webs 18 between the slot ends, such that the slots 16 open to create diamond-shaped apertures 16*a*. The buckling of the tubing 14 results in the diameter described by the tubing increasing, as well as the length of the tubing 14 decreasing. Continued compression of the tubing 14 produces further buckling and expansion, until the initially buckled portion of the tubing 14 contacts and is restrained against further expansion by the liner 10. Still further compression of the tubing 14 results in adjacent portions of the tubing expanding until they too engage the liner 10. As may be seen from FIG. 3, this results in the tubing 14 engaging a section of the liner 10, of length "L".

To minimise the possibility of relative axial movement between the expanded tubing 14 and the liner 10, the tubing 14 carries gripping elements in the form of small, sharp particles of relatively hard material, in the form of carbide chips 24.

It is apparent that the tubing 14 has undergone a significant degree of expansion, from an initial o.d. of 2.875" to an expanded o.d. of 6.2", that is an expansion ratio in excess of two. Clearly, it would be difficult to obtain such a degree of expansion utilising a conventional expansion tool.

To minimise the possibility of relative axial movement between the expanded tubing 14 and the liner 10, the tubing 14 carries gripping elements in the form of small, sharp particles of relatively hard material, in the form of carbide chips 26.

The running string 20 is then uncoupled from the tubing 14, which remains in the liner 10 to serve as an anchor for a tool or device subsequently run into the bore and coupled to the tubing 14.

If subsequently it is desired to remove the tubing 14 this may be achieved by running an appropriate tool into the tubing 14, and which tool may then be actuated to axially extend the tubing 14, such that the tubing 14 contracts radially, out of engagement with the liner 10.

Figure 4:
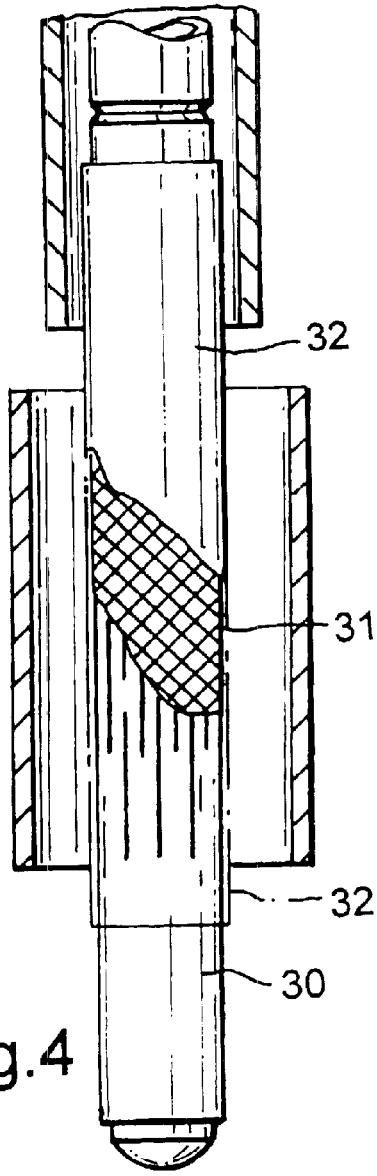
FIG. 4 is a part-sectional schematic view of expansion apparatus in accordance with another embodiment of the present invention.

Reference is now made to FIG. 4 of the drawings, which corresponds essentially to FIG. 1, but illustrates slotted expandable tubing 30 provided with an elastomeric sleeve 32 (shown in chain-dotted outline), which maintains the tubing 30 fluid-tight in both the expanded and unexpanded conditions. The expanded tubing may thus act as, for example, a straddle or even a packer, as described below.

As is apparent from FIG. 3 above, expanded slotted tubing features diamond-shaped apertures; the sleeve 32 extends across these apertures and, in the absence of internal support, an external pressure may result in failure of the sleeve. Accordingly, a support structure comprising an aramid weave 31 is provided between the tubing 30 and the sleeve 32. The weave 31 behaves in a somewhat similar fashion to the tubing 30 on expansion, in that as the weave diameter increases, the weave length decreases, in concert with the tubing 30. In other embodiments, the support may take other forms, for example of a somewhat similar form to the strips of metal featured on the exterior of inflated element packers.

Figure 5:
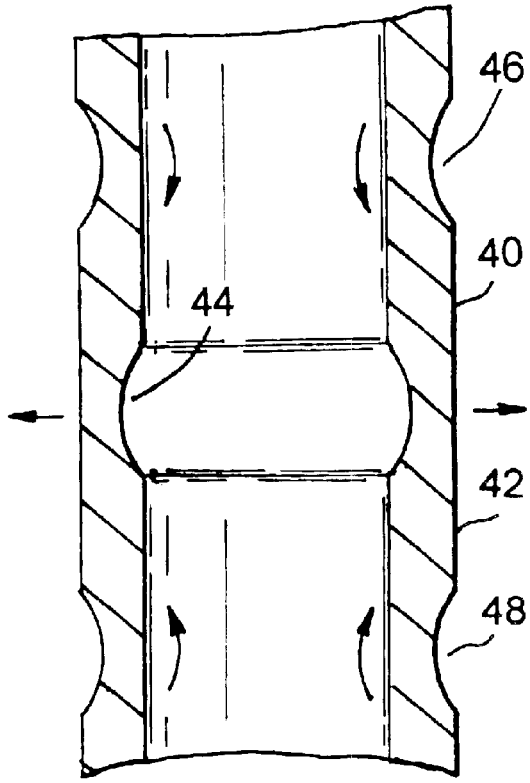
FIG. 5 is a sectional view of a wall of tubing in accordance with a further embodiment of the present invention.

Reference is next made to FIG. 5 of the drawings, which illustrates a sectional view of a wall of a section of expandable tubing 40 in accordance with a further embodiment of the present invention. It will be noted that the tubing wall 42 is relatively thin at three locations, that is a central location 44, and at locations 46, 48 above and below the central location 44.

On the wall 42 being subject to a compressive force, the wall configuration at the central location 44 creates a bias tending to induce radially outward buckling. Furthermore, the thinning at the upper and lower locations 46, 48 creates a bias inducing a couple further serving to induce radially outward buckling at the central location 44.

By providing tubing 40 with the illustrated wall configuration, the running tool for the tubing 40 may be simplified, as it is not necessary to mechanically induce the desired buckling configuration.

Figure 6:
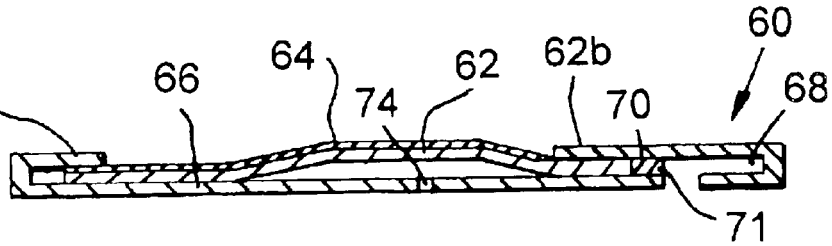
FIGS. 6 and 7 are schematic sectional views of a packer arrangement in accordance with a still further embodiment of the present invention.
Figure 7:
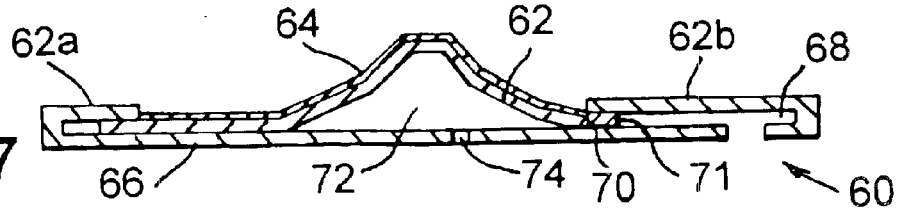

Reference is now made to FIGS. 6 and 7 of the drawings, which are schematic sectional views of a packer arrangement 60 in accordance with a still further embodiment of the present invention. The packer 60 includes a section of expandable slotted tubing 62 having an elastomeric sleeve 64 mounted thereon, in a similar manner to the embodiment of FIG. 4. However, the tubing 62 is mounted on a tubular mandrel 66, with one end of the tubing 62*a* being fixed and sealed to the mandrel 66, and the other end of the tubing 62*b* being sealed to but axially movable relative to the mandrel 66. The tubing end 62*b* is in fact located in an annular chamber 68 which contains a piston 70 having one face in contact with the tubing end 62*b* and the other face exposed to Internal tubing pressure. The piston 70 carries a one-way ratchet ring 71, which engages a corresponding ratchet face on the mandrel 66.

The packer 60 may thus be run into a bore in the configuration as illustrated in FIG. 6. If an elevated pressure is then applied to the interior of the mandrel 66, the piston 70 is urged to compress and buckle the tubing 62, such that the sleeve 64 is brought into sealing contact with the surrounding bore wall.

As noted above, to assist in maintaining the extended form of the tubing 62, the piston 70 includes a ratchet ring 71, such that on bleeding off the internal pressure the piston 70 is retained in the advanced position. In addition, the packer is arranged such that the volume 72 between the extended tubing 62 and the mandrel 66 fills with incompressible bore fluid, via a flow port 74 provided with a one-way valve, such that the fluid becomes trapped in the volume 72 on the tubing 62 reaching its fully extended configuration. In another embodiment, the piston may be coupled to a sleeve which closes the port on the piston reaching its advanced position.

Figure 8:
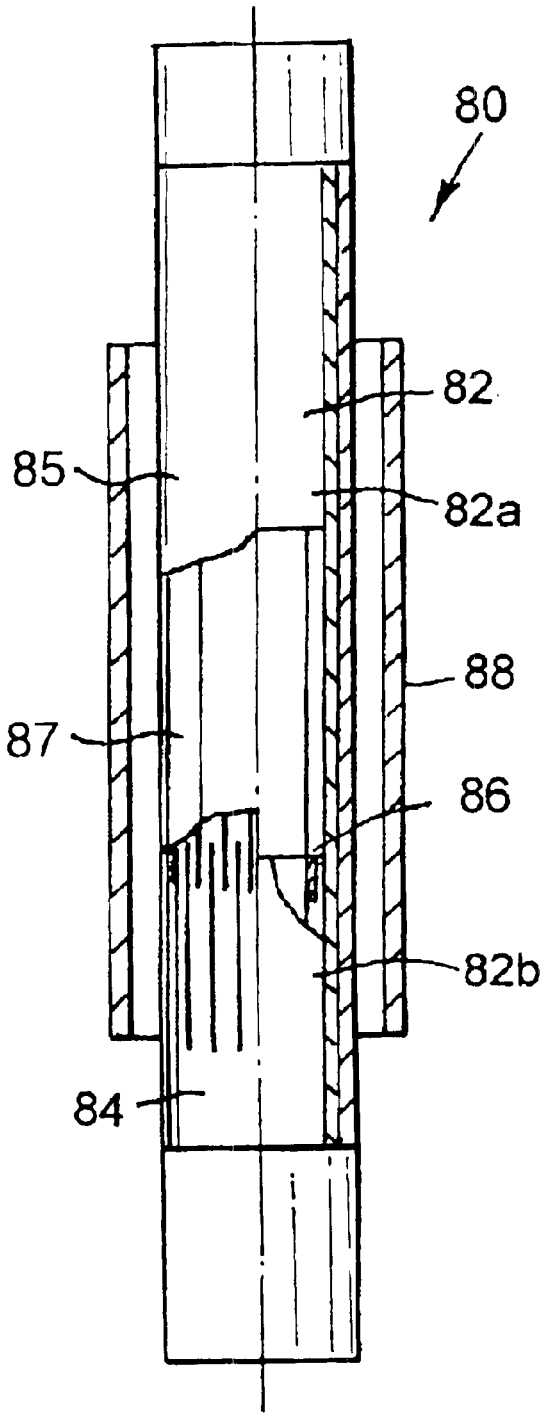
FIGS. 8 and 9 are schematic part-sectional views of a packer arrangement in accordance with a yet further embodiment of the present invention.
Figure 9:
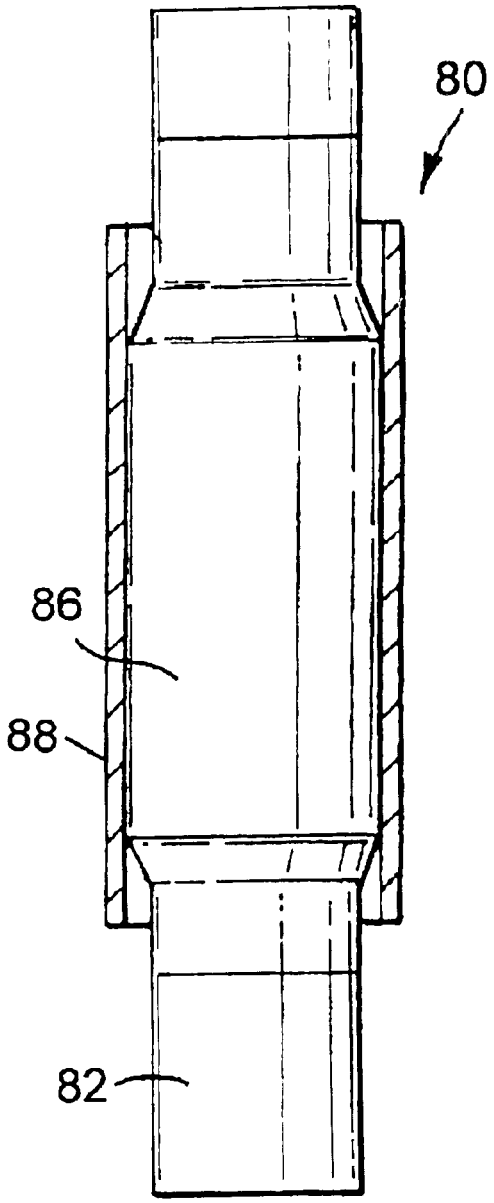

Reference is now made to FIGS. 8 and 9 of the drawings, which are schematic sectional views of a packer arrangement 80 in accordance with a yet further embodiment of the present invention. The packer 80 comprises a telescopic mandrel 82 having mounted thereon a section of expandable slotted tubing 84 surrounded by an elastomeric sleeve 86, with sleeve-supporting strips of metal 88 provided between the tubing 84 and the sleeve 86.

As noted above, the mandrel 82 is telescopic and comprises two principal parts 82*a*, 82*b*, each end of the tubing 84 being fixed and sealed to a respective part. Further, a ratchet arrangement 86 is provided between the parts 82*a*, 82*b*, which arrangement 86 permits contraction of the mandrel 82, but resists extension of the mandrel.

Reference is now made to FIGS. 8 and 9 of the drawings, which are schematic sectional views of a packer arrangement 80 in accordance with a yet further embodiment of the present invention. The packer 80 comprises a telescopic mandrel 82 having mounted thereon a section of expandable slotted tubing 84 surrounded by an elastomeric sleeve 85, with sleeve-supporting strips of metal 87 provided between the tubing 84 and the sleeve 85.

If it is subsequently desired to release the packer 80, the ratchet 86 may be sheared out, the mandrel 82 extended, and the tubing 84 returned to its original, cylindrical configuration.

Figure 10:
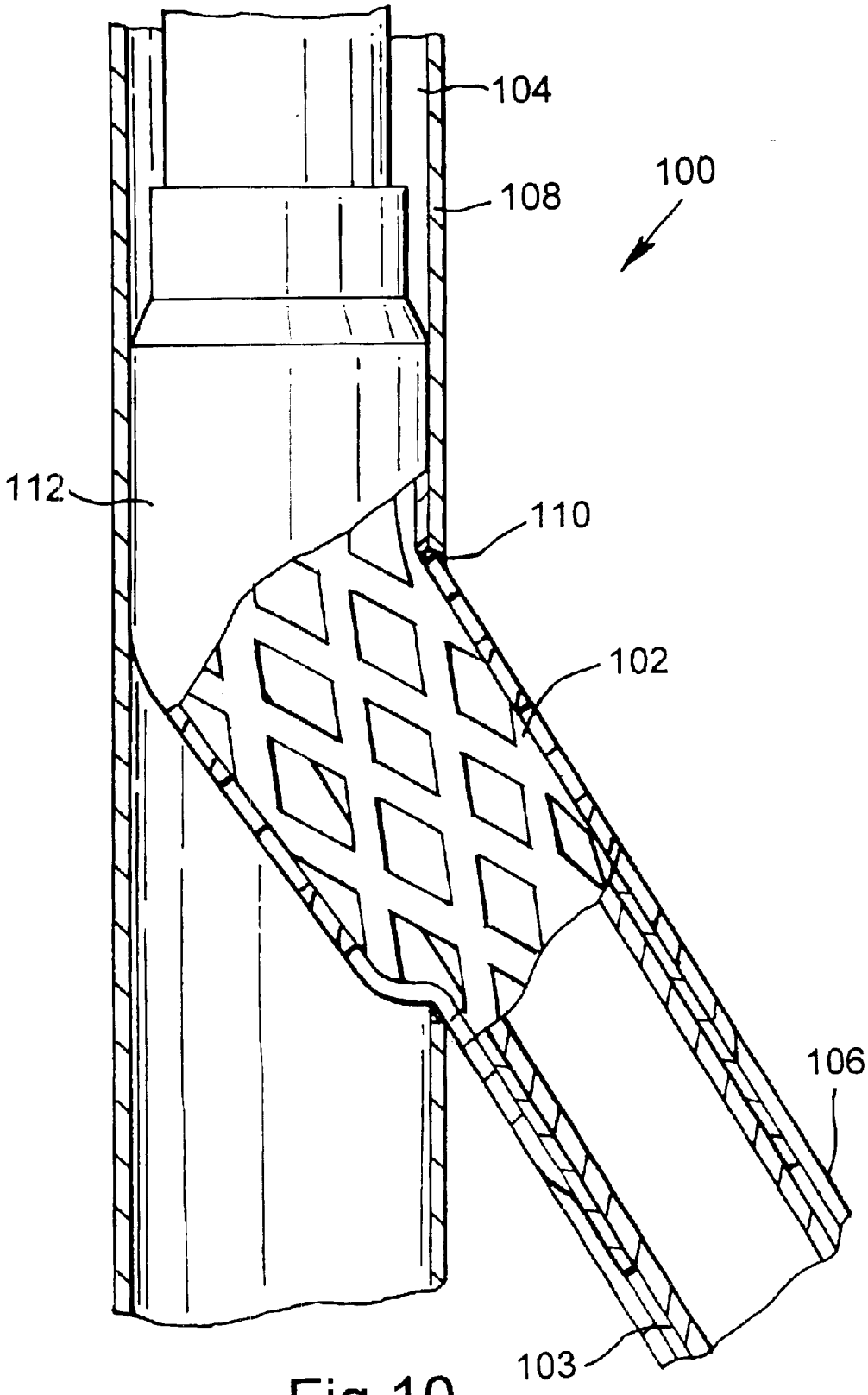
FIG. 10 is a schematic sectional view of a multilateral well junction comprising tubing which has been expanded in accordance with a method of an embodiment of the present invention.

Reference is now made to FIG. 10 of the drawings, which is a schematic sectional view of a multilateral well junction 100 comprising tubing 102 which has been expanded in accordance with a method of an embodiment of the present invention. The tubing 102 is mounted on a tubular mandrel 103.

The tubing 102 is slotted and positioned to extend between a parent wellbore 104 and a lateral wellbore 106. The parent wellbore 104 is lined with casing 108 which has been milled to create the exit portal 110 into the lateral wellbore 106.

The tubing 102 carries a supported and sheathed elastomeric sleeve 112 and is run into the junction 100 in unexpanded form. The tubing 102 is then axially compressed such that at least the portion of the tubing 102 located in the aperture 110 buckles and extends radially to engage the walls of the aperture 110. The resulting snug fit with the walls of the aperture serves to locate the tubing 102, and the mandrel 103 on which the tubing 102 is mounted, securely in the portal 110, and the nature of the expansion is such that the tubing 102 will tend to expand until the tubing engages the surrounding portal wall; it is immaterial that portal 110 is not truly circular (typically, the aperture will be oval).

The tubing 102 and mandrel 103 may then serve to assist in positioning and sealing casing which is subsequently run into and cemented in the lateral wellbore 106, and to assist in the creation of a hydraulic seal between the wellbores 104, 106.

Figure 11:
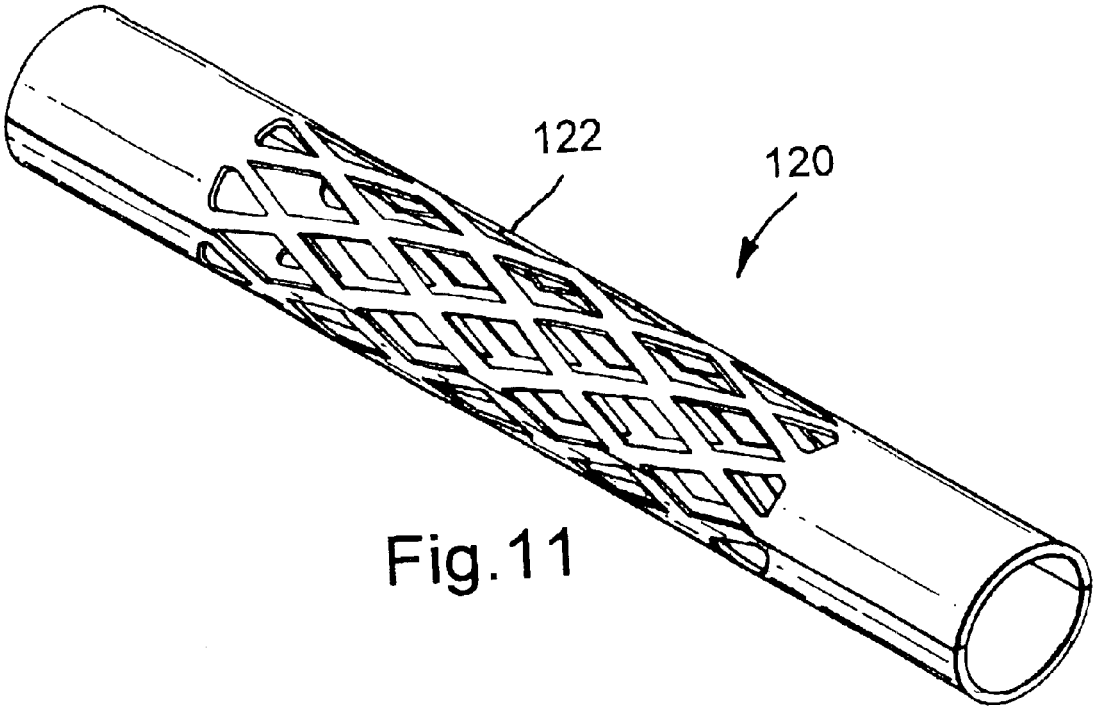
FIG. 11 is a perspective view of expandable tubing in accordance with an alternative embodiment of the present invention.
Figure 12:
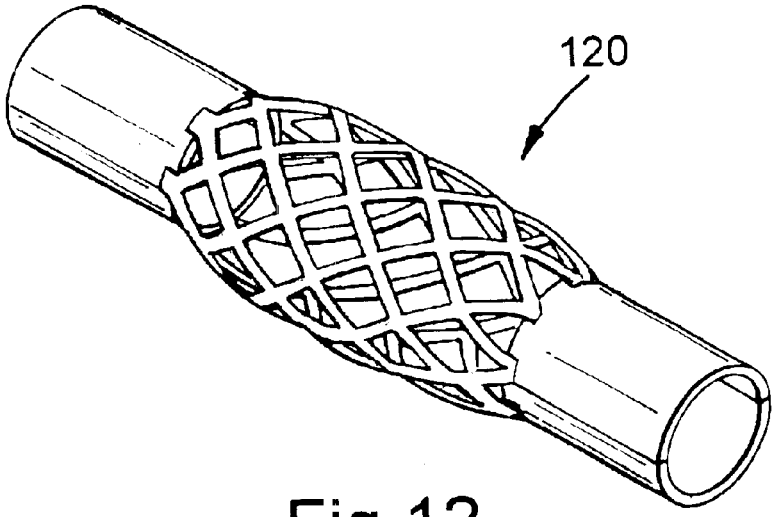
FIGS. 12 to 16 illustrate steps in the expansion of the tubing of FIG. 11.
Figure 13:
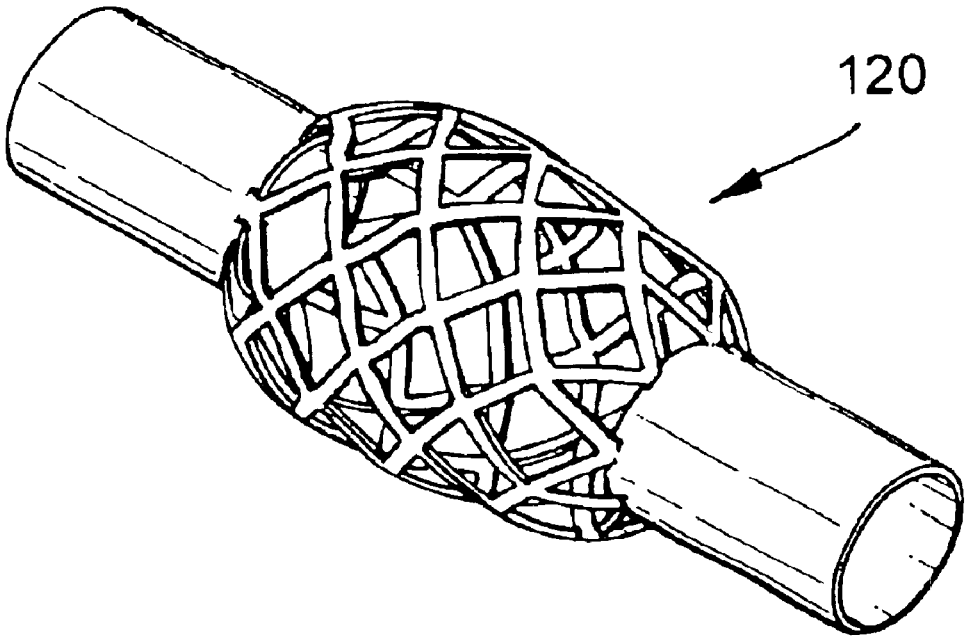
Figure 14:
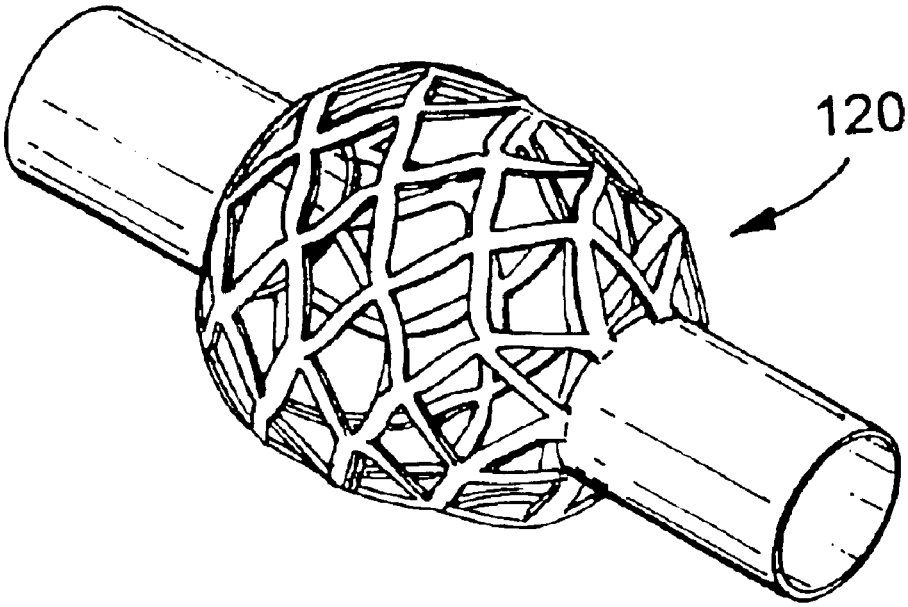
Figure 15:
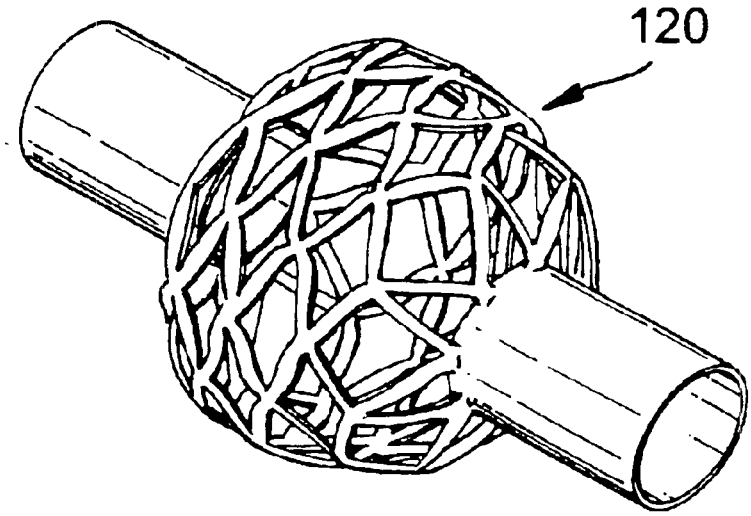

Reference is now made to FIGS. 11 to 16 of the drawings, which relate to an alternative embodiment of the present invention in which the expandable tubing 120, shown in unexpanded condition in FIG. 11, initially defines a plurality of diamond-shaped apertures 122. The illustrated tubing 120 is initially 3d" diameter, and FIGS. 12 to 16 illustrate the tubing when subject to axial displacement of 1", 2", 3", 4" and 5", respectively.

Figure 16:
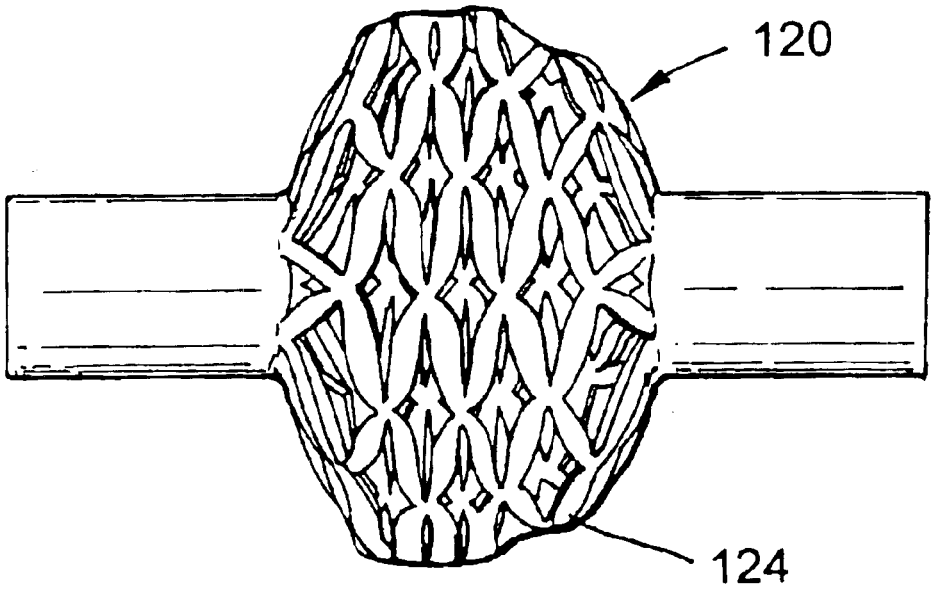

It will be observed that the diameter of the expanded tubing portion 124 of FIG. 16 is almost three times the diameter of the original tubing, but those of skill in the art will appreciate that an expansion ratio which is even a fraction of this may be useful in many applications.

Furthermore, the manufacture of the apertured tubing 120 is generally more straightforward than the manufacture of the slotted tubing: whereas the slots must be cut, typically by water-jetting or laser, the apertures may be punched from the tubing.

The apertured tubing 120 may of course be used in place of slotted tubing in any of the above-described embodiments of the invention.

It will be apparent to those of skill in the art that the above described embodiments of the invention provide significant advantages over the expansion methods of the prior art, facilitate achievement of expansion ratios hitherto unavailable, and provide alternative configuration anchors and packers. Furthermore, in addition to the applications described above, the invention may be utilised to, for example, anchor piles in bores drilled in the sea bed, for use in securing offshore structures. The above embodiments also relate solely to applications in which tubing is plastically deformed; in alternative embodiments, the invention may be utilised to provide only elastic deformation, such that release of the deforming force allows the tubing to return to its original form.

We claim:

1. A method of expanding tubing downhole, the method comprising:

providing a section of expandable metal tubing of a first diameter; and axially compressing the tubing, thereby buckling at least a portion of the tubing, such that said buckled portion describes a larger second diameter.

2. The method of claim 1, wherein said portion of the tubing is slotted, and on expansion of the tubing the slots open.

3. The method of claim 2, further comprising providing an expandable sleeve in combination with the tubing, the sleeve maintaining the wall of the tubing fluid-tight, and providing a support between the sleeve and the tubing to support the portions of the sleeve extending over the open slots in the expanded tubing.

4. The method of claim 1, wherein said portion of the tubing defines apertures, and on expansion of the tubing the apertures at least partially close.

5. The method of claim 1, further comprising providing an expandable sleeve in combination with the tubing, the sleeve maintaining the wall of the tubing fluid-tight.

6. The method of claim 1, further comprising mounting the tubing on a mandrel.

7. The method of claim 6, wherein the tubing is mounted in sealing engagement with the mandrel.

8. The method of claim 1, wherein the degree of expansion of the tubing is selected to provided engagement with a surrounding structure.

9. The method of claim 8, wherein the degree of expansion is selected to anchor the tubing to the surrounding structure.

10. The method of claim 8, wherein the degree of expansion is selected to provide sealing engagement with the surrounding structure.

11. The method of claim 8, wherein the surrounding structure is liner.

12. The method of claim 8, wherein the surrounding structure is the wall of an open bore.

13. The method of claim 8, wherein the surrounding structure is a portal between a parent wellbore and a lateral wellbore.

14. The method of claim 1, wherein the tubing is pre-expanded before application of the compressive force thereto.

15. The method of claim 14, wherein the pre-expansion takes place downhole.

16. The method of claim 1, further comprising providing a compression tool within the tubing with portions engaging the tubing to either end of the portion to be compressed, and bringing said portions together to expand the tubing.

17. The method of claim 16, wherein the compression tool is fluid-pressure actuated.

18. The method of claim 1, wherein the compression of the tubing is achieved by applying weight to the tubing from surface.

19. The method of claim 1, comprising providing expandable tubing having a wall configured to induce buckling in a predetermined direction on the tubing wall experiencing compression.

20. The method of claim 1, wherein the expansion ratio achieved is in excess of 1.3.

21. The method of claim 20, wherein the expansion ratio achieved is in excess of 1.4.

22. The method of claim 21, wherein the expansion ratio achieved is in excess of 1.5.

23. The method of claim 1, wherein the expandable tubing is run in to an expansion location through production tubing.

24. The method of claim 1, wherein the tubing is plastically deformed.

25. The method of claim 1, further comprising the step of axially extending said buckled portion of the tubing such that said extended portion describes a smaller diameter.

26. A method of expanding tubing downhole, the method comprising:

providing a section of expandable tubing of a first tubing diameter;

running the tubing into a bore and through a bore restriction of a first bore diameter;

locating the tubing in a section of the bore of a larger second bore diameter; and axially compressing at least a portion of the tubing to induce buckling at said portion, said buckled portion then describing said larger second tubing diameter.

27. The method of claim 26, wherein the buckled portion of the tubing is plastically deformed and said plastic expansion of said portion of the tubing to said larger second tubing diameter is achieved in a single expansion step.

28. The method of claim 26, wherein the bore is defined, at least in part, by production tubing.

29. The method of claim 26, wherein the section of the bore of larger second bore diameter is defined, at least in part, by bore liner.

30. The method of claim 26, wherein said second tubing diameter corresponds to said second bore diameter.

31. The method of claim 26, wherein the expansion ratio achieved is in excess of 1.3.

32. The method of claim 31, wherein the expansion ratio achieved is in excess of 1.4.

33. The method of claim 32, wherein the expansion ratio achieved is in excess of 1.5.

34. The method of claim 33, wherein the expansion ratio is in excess of 2.

35. Tubing running and expansion apparatus comprising:

a length of expandable metal tubing; and a running tool for supporting the tubing on a running string and including means for compressing the tubing to induce buckling and expansion thereof.

36. The apparatus of claim 35, wherein the compressing means comprises means for engaging two axially spaced portions of the tubing and means for bringing said portions together to compress the tube.

37. The apparatus of claim 35, wherein the compressing means is telescopic.

38. The apparatus of claim 35, further comprising means for retaining compression of said tubing.

39. The apparatus of claim 38, wherein said means for retaining compression comprises a ratchet arrangement.

40. The apparatus of 35, wherein the compressing means is adapted to transfer weight applied to a running string to the tubing.

41. The apparatus of claim 35, wherein the compressing means is fluid pressure actuated.

42. The apparatus of claim 35, further comprising an expandable fluid-tight sleeve mounted on the tubing.

43. The apparatus of claim 35, further comprising gripping means provided on an exterior face of the tubing for engaging a surrounding structure.

44. The apparatus of claim 35, wherein at least a portion of the tubing is slotted.

45. The apparatus of claim 44 further comprising:

an expandable sleeve mounted on the tubing, the sleeve maintaining the wall of the tubing fluid-tight; and a support between the sleeve and the tubing to support the portions of the sleeve extending over the open slots in the expanded tubing.

46. The apparatus of claim 45, wherein the support comprises a matrix of fibres.

47. The apparatus of claim 45, wherein the support comprises a plurality of overlapping leaves mounted to the tubing.

48. The apparatus of claim 35, wherein at least a portion of the tubing is apertured.

49. The apparatus of claim 48, wherein the apertures in the tubing are initially diamond-shaped.

50. The apparatus of claim 35, further comprising a mandrel.

51. The apparatus of claim 50, wherein the tubing is mounted in sealing engagement with the mandrel.

52. The apparatus of claim 35, wherein the tubing is pre-expanded.

53. The apparatus of claim 35, wherein the expandable tubing has a wall configured to induce buckling in a predetermined direction on the tubing wall experiencing compression.

54. An apparatus for use in a wellbore, comprising a metal tubing section configured to facilitate buckling when the tubing section is axially compressed, thereby expanding at least a portion of the tubing section into engagement with a surrounding structure.

55. The apparatus claim 54, wherein the portion of the tubing section is plastically expanded.

56. The apparatus of claim 54, wherein the portion of the tubing secures the tubing section to the surrounding structure.

57. The apparatus of claim 56, wherein the surrounding structure is a portal between a parent wellbore and a lateral wellbore.

58. The apparatus of claim 54, wherein the portion of the tubing creates a seal between the tubing section and the surrounding structure.

59. The apparatus of claim 54, wherein the portion of the tubing is slotted.

60. The apparatus of claim 54, wherein the portion of the tubing comprises apertures.

61. The apparatus of claim 54, wherein the portion of the tubing is configured to create a bias towards buckling radially outward when the tubing section is axially compressed.

62. A method of expanding tubing downhole, the method comprising:

providing a section of expandable metal tubing of a first diameter, the tubing having a wall; and axially compressing the tubing to induce localized buckling at a portion of the wall, such that said portion describes a larger second diameter.

63. The method of claim 62, wherein the portion of the wall is slotted.

64. The method of claim 62, wherein the portion of the wall comprises apertures.

65. The method of claim 62, wherein the portion of the wall is configured to create a bias towards buckling radially outward when the tubing section is axially compressed.

66. A method of expanding tubing downhole, the method comprising:

providing a section of expandable tubing of a first diameter; and axially compressing at least a portion of the tubing to induce buckling at said portion, such that said buckled portion describes a larger second diameter, wherein the tubing is plastically deformed.

67. The method of claim 66, wherein said portion of the tubing is slotted, and on expansion of the tubing the slots open.

68. The method of claim 66, wherein said portion of the tubing defines apertures, and on expansion of the tubing the apertures at least partially close.

69. The method of claim 66, further comprising providing an expandable sleeve in combination with the tubing, the sleeve maintaining the wall of the tubing fluid-tight.

70. The method of claim 66, further comprising providing an expandable sleeve in combination with the tubing, the sleeve maintaining the wall of the tubing fluid-tight, and providing a support between the sleeve and the tubing to support the portions of the sleeve extending over the open slots in the expanded tubing.

71. The method of claim 66, wherein the degree of expansion of the tubing is selected to provided engagement with a surrounding structure and the surrounding structure is the wall of an open bore.

72. The method of claim 66, wherein the degree of expansion of the tubing is selected to provided engagement with a surrounding structure and the surrounding structure is a portal between a parent wellbore and a lateral wellbore.

73. The method of claim 66, wherein the tubing is pre-expanded before application of the compressive force thereto.

74. The method of claim 73, wherein the pre-expansion takes place downhole.

75. The method of claim 66, wherein the expansion ratio achieved is in excess of 1.3.

76. The method of claim 75, wherein the expansion ratio achieved is in excess of 1.4.

77. The method of claim 76, wherein the expansion ratio achieved is in excess of 1.5.

78. Tubing running and expansion apparatus comprising:

a length of expandable tubing;

a running tool for supporting the tubing on a running string and including means for compressing the tubing to induce buckling and expansion thereof; and means for retaining compression of said tubing comprising a ratchet arrangement.

79. Tubing running and expansion apparatus comprising:

a length of expandable tubing;

a running tool for supporting the tubing on a running string and including means for compressing the tubing to induce buckling and expansion thereof; and an expandable fluid-tight sleeve mounted on the tubing.

80. Tubing running and expansion apparatus comprising:

a length of expandable tubing, wherein at least a portion of the tubing is slotted; and a running tool for supporting the tubing on a running string and including means for compressing the tubing to induce buckling and expansion thereof.

81. The apparatus of claim 80, further comprising:

an expandable sleeve mounted on the tubing, the sleeve maintaining the wall of the tubing fluid-tight; and a support between the sleeve and the tubing to support the portions of the sleeve extending over the open slots in the expanded tubing.

82. The apparatus of claim 81, wherein the support comprises a matrix of fibres.

83. The apparatus of claim 81, wherein the support comprises a plurality of overlapping leaves mounted to the tubing.

84. Tubing running and expansion apparatus comprising:

a length of expandable tubing, wherein at least a portion of the tubing is apertured; and a running tool for supporting the tubing on a running string and including means for compressing the tubing to induce buckling and expansion thereof.

85. The apparatus of claim 84, wherein the apertures in the tubing are initially diamond-shaped.

86. Tubing running and expansion apparatus comprising:

a length of expandable tubing, wherein the tubing is pre-expanded; and a running tool for supporting the tubing on a running string and including means for compressing the tubing to induce buckling and expansion thereof.

87. An apparatus for use in a wellbore, comprising a tubing section constructed and arranged to be axially compressed to induce buckling, thereby expanding a portion of the tubing section into engagement with a surrounding structure, wherein the portion creates a seal between the tubing section and the surrounding structure.

* * * * *